US010490963B2

(12) United States Patent
Hung

(10) Patent No.: US 10,490,963 B2
(45) Date of Patent: Nov. 26, 2019

(54) DETACHABLE CASSETTE FOR MACHINING CONNECTOR AND CRIMP TOOL

(71) Applicant: Robert W. Sullivan, Simi Valley, CA (US)

(72) Inventor: Wen-Lung Hung, New Taipei (TW)

( * ) Notice: Subject to any disclaimer, the term of this patent is extended or adjusted under 35 U.S.C. 154(b) by 410 days.

(21) Appl. No.: 14/998,646

(22) Filed: Jan. 29, 2016

(65) Prior Publication Data

US 2017/0104305 A1 Apr. 13, 2017

(30) Foreign Application Priority Data

Oct. 13, 2015 (TW) ..... 104133572 A

(51) Int. Cl.
*H01R 43/04* (2006.01)
*H01R 43/042* (2006.01)
*B25B 27/14* (2006.01)

(52) U.S. Cl.
CPC ..... *H01R 43/0421* (2013.01); *B25B 27/14* (2013.01); *H01R 43/0425* (2013.01)

(58) Field of Classification Search
CPC ..... H01R 43/042; H01R 43/0421; H01R 43/0425; B25B 27/146
See application file for complete search history.

(56) References Cited

U.S. PATENT DOCUMENTS 5,913,933 A 6/1999 Beetz et al.
5,941,120 A 8/1999 Jee
7,103,968 B2 9/2006 Karrasch
8,296,956 B2 10/2012 Battenfeld
8,839,506 B2 9/2014 Slater et al.
(Continued)

FOREIGN PATENT DOCUMENTS

EP 2026433 A2 2/2009
EP 2166625 A2 3/2010
(Continued)

OTHER PUBLICATIONS

European Patent Office (EPO); Office Action (OA) for corresponding patent application No. 16 154 476.2 entitled Detachable Cassette for Machining Connector and Crimp Tool Having the Same by Wen-Lung Hung, dated Feb. 16, 2018 from European Patent Office, 6 pgs.

(Continued)

*Primary Examiner* — Debra M Sullivan
(74) *Attorney, Agent, or Firm* — Charles C. H. Wu; Charles C.H. Wu & Assoc., APC

(57) ABSTRACT

The invention is related to a cassette for machining a connector. The cassette is detachably disposed in a tool body having a head and a driving element. The direction of motion of the driving element defines a first axle. The cassette comprises: a cassette body and a machining block. The cassette body is detachably disposed in an opening of the head of the tool body and has a machining opening therein. The machining block is slidably disposed in the cassette body along the first axle and has an engagement element detachably engaged with the driving element of the tool body. Through the engagement element, the driving element drives the machining block to slide along the first axle to move toward or away from the machining opening.

18 Claims, 9 Drawing Sheets

(56) References Cited

U.S. PATENT DOCUMENTS

| | | | | |
|---|---|---|---|---|
| 2002/0056309 | A1 | 5/2002 | Beetz et al. | |
| 2009/0044410 | A1 | 2/2009 | Battenfeld | |
| 2009/0217791 | A1* | 9/2009 | Battenfeld | B25B 7/04 81/421 |
| 2010/0071202 | A1* | 3/2010 | Peng | B25B 27/146 29/751 |
| 2011/0047790 | A1 | 3/2011 | Peng et al. | |
| 2012/0110837 | A1 | 5/2012 | Slater et al. | |
| 2012/0144893 | A1 | 6/2012 | Battenfeld | |
| 2013/0125381 | A1 | 5/2013 | Lin | |

FOREIGN PATENT DOCUMENTS

| | | | |
|---|---|---|---|
| JP | 2009-050152 | A1 | 3/2009 |
| JP | 2009050152 | A | 3/2009 |

OTHER PUBLICATIONS

Japan Patent Office (JPO); Office Action (OA) English translation for corresponding patent application No. 2016-201640 entitled Detachable Cassette for Machining Connector and Crimp Tool Having the Same by Wen-Lung Hung, dated Feb. 13, 2018 from Japan Patent Office, 4 pgs.

Platinum Tools; EZ-Viking Crimp Tool Catalog published in Jan. 2013 from Platinum Tools in Camarillo, California, United States of America, 2 pgs.

Korean Intellectual Property Office (KIPO); First Office Action (1OA) English translation for corresponding Korean patent application No. 10-2016-0132743, entitled Detachable Cassette for Machining Connector and Crimp Tool Having the Same by Wen-Lung Hung, dated Aug. 17, 2017 from Korean Intellectual Property Office, 5 pgs.

Korean Intellectual Property Office (KIPO); Second (2OA) English translation Office Action for corresponding Korean patent application No. 10-2016-0132743, entitled Detachable Cassette for Machining Connector and Crimp Tool Having the Same by Wen-Lung Hung, dated Mar. 29, 2018 from Korean Intellectual Property Office, 4 pgs.

Korean Intellectual Property Office (KIPO); Final Rejection (Final_Rej) English translation Office Action for corresponding Korean patent application No. 10-2016-0132743, entitled Detachable Cassette for Machining Connector and Crimp Tool Having the Same by Wen-Lung Hung, dated Sep. 17, 2018 from Korean Intellectual Property Office, 6 pgs.

Taiwan Intellectual Property Office (IPO); First Office Action (1OA) English translation for corresponding Taiwan patent application No. 106107281 entitled Detachable Cassette for Machining Connector and Crimp Tool Having the Same by Wen-Lung Hung, dated Nov. 30, 2017 from Intellectual Property Office, 7 pgs.

Intellectual Property Office (IPO); Search Report (Search_Rpt-DV1) English translation for corresponding Taiwan patent application No. 106107281 entitled Detachable Cassette for Machining Connector and Crimp Tool Having the Same by Wen-Lung Hung, dated Nov. 30, 2017 from Intellectual Property Office, 2 pgs.

Intellectual Property Office (IPO); First Office Action (1OA) English translation for corresponding Taiwan patent application No. 107114756 entitled Detachable Cassette for Machining Connector and Crimp Tool Having the Same by Wen-Lung Hung, dated Nov. 29, 2018 from Intellectual Property Office, 4 pgs.

Intellectual Property Office (IPO); Search Report (Search_Rpt-DV2) English translation for corresponding Taiwan patent application No. 107114756 entitled Detachable Cassette for Machining Connector and Crimp Tool Having the Same by Wen-Lung Hung, dated Nov. 28, 2018 from Intellectual Property Office, 2 pgs.

Korean Intellectual Property Office (KIPO); First Office Action (1OA) English translation for corresponding Korean patent application No. 10-2019-0008929, entitled Detachable Cassette for Machining Connector and Crimp Tool Having the Same by Wen-Lung Hung, dated Apr. 29, 2019 from Korean Intellectual Property Office, 3 pgs.

European Patent Office (EPO); extended European Search Report (eESR) for corresponding patent application No. 19 15 4961.7 entitled Detachable Cassette for Machining Connector and Crimp Tool Having the Same by Wen-Lung Hung, dated May 16, 2019 from European Patent Office, 9 pgs.

* cited by examiner

DETACHABLE CASSETTE FOR MACHINING CONNECTOR AND CRIMP TOOL

CROSS-REFERENCE TO RELATED APPLICATIONS

The present invention claims the benefit of priority of Taiwan application No. 104133572 of Oct. 13, 2015, entitled "Detachable Cassette for Machining Connector and Crimp Tool Having the Same," the contents of which are herein incorporated by reference.

BACKGROUND

Field of the Invention

The present invention relates to a device for machining an article, in particular a detachable cassette for machining a connector and a crimp tool having the same.

Description of Related Art

Cables or wires are commonly used for transmitting signals between electronic devices. For example, cables are used for transmitting signals from and to televisions, telephones, computers etc. These signals include: video signals, audio signals and packed data. Connectors are used for connecting cables with electronic devices and are usually disposed at the ends of the cables. These connectors include an RJ-45 connector, a connector standardized as the 8P8C modular connector, and an RJ-11 connector, a connector for telephone connections etc. When the connector housing is crimped to secure the internal position of the wires, its internally contained electrical contact blades also assume the positions in which they will matingly engage the blades of corresponding contacts in the receptacle of an associated female connector. Conventional crimp tools, such as the pliers described in U.S. Pat. No. 5,941,120, are used for crimping insulated cables and connectors so that they are electrically and physically connected. Furthermore, Taiwan Pat. Pub. No. 534510 discloses a tool for crimping a cable connector, which can shear, strip and crimp insulated cables respectively with different portions thereof.

However, each of these conventional tools can only crimp connectors and cables of particular specifications. Thus, to crimp connectors and cables with different specifications, a user needs to carry several different crimp tools, which is inconvenient and cumbersome for the user.

Given the above, there is need for a single crimp tool that can crimp connectors and cables with different specifications.

BRIEF SUMMARY OF THE INVENTION

In one embodiment of the invention, a cassette for machining a connector is provided. The cassette is detachably disposed in a tool body having a head and a driving element. The direction of motion of the driving element defines a first axis. The cassette comprises: a cassette body and a machining block. The cassette body is detachably disposed in an opening of the head of the tool body and has a machining opening therein. The machining block is slidably disposed in the cassette body along the first axis and has an engagement element detachably engaged with the driving element of the tool body. Through the engagement element, the driving element drives the machining block to slide along the first axis to move toward or away from the machining opening.

In another embodiment of the invention, a crimp tool is provided, which comprises: a tool body and a cassette. The tool body comprises: a first handle, a second handle, a head and a driving element. The second handle is pivotally connected with the first handle. The head is connected with the first handle. The driving element is connected with and actuated by the second handle. The direction of motion of the driving element defines a first axis. The cassette comprises: a cassette body and a machining block. The cassette body is detachably disposed in an opening of the head of the tool body and has a machining opening therein. The machining block is slidably disposed in the cassette body along the first axis and has an engagement element for being detachably engaged with the driving element of the tool body. Through the engagement element, the driving element drives the machining block to slide along the first axis to move toward or away from the machining opening.

BRIEF DESCRIPTION OF THE DRAWINGS

FIG. 5A is still a further schematic view showing the cassette of the embodiment in the working state wherein the crimping structure is shown;

DETAILED DESCRIPTION OF THE EXEMPLARY EMBODIMENTS

Figure 1A:
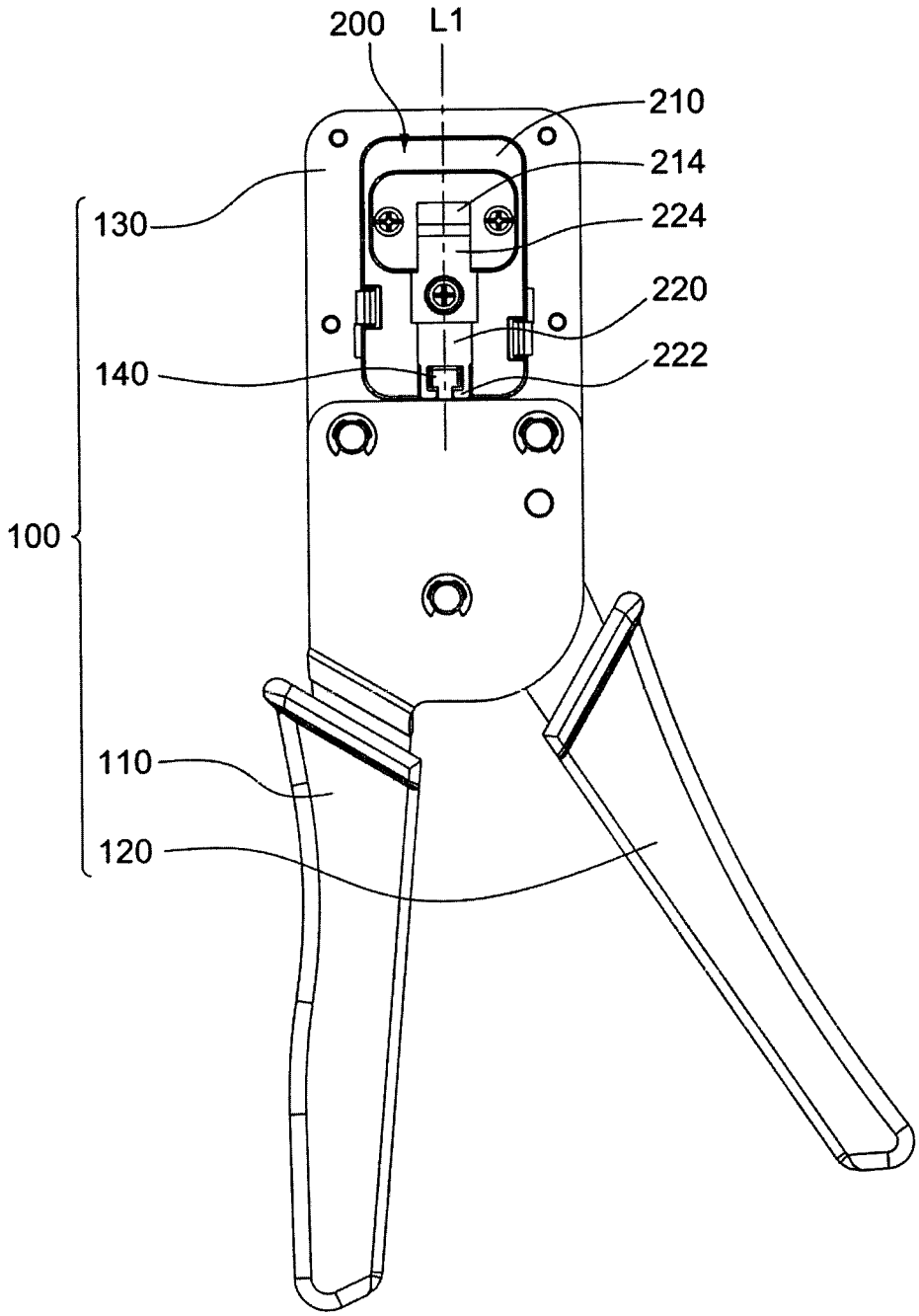
FIG. 1A is a schematic view showing the crimp tool of one embodiment of the present invention in a resting state.

The characteristics, subject matter, advantages, and effects of the present invention are detailed hereinafter by reference to embodiments of the present invention and the accompanying drawings. It is understood that the drawings referred to in the following description are intended only for purposes of illustration and do not necessarily show the actual proportion and precise arrangement of the embodiments. Therefore, the proportion and arrangement shown in the drawings should not be construed as limiting or restricting the scope of the present invention.

Figure 1B:
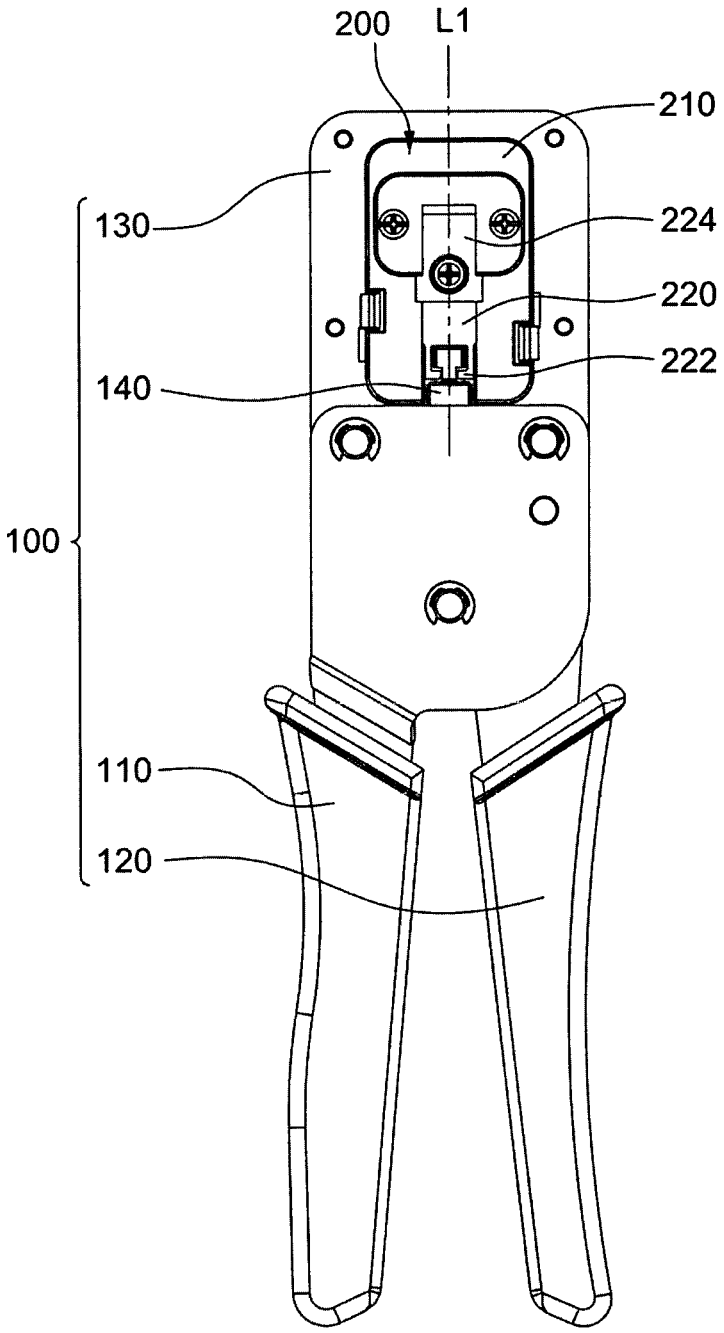
FIG. 1B is a schematic view showing the crimp tool of the embodiment in a working state.
Figure 2A:
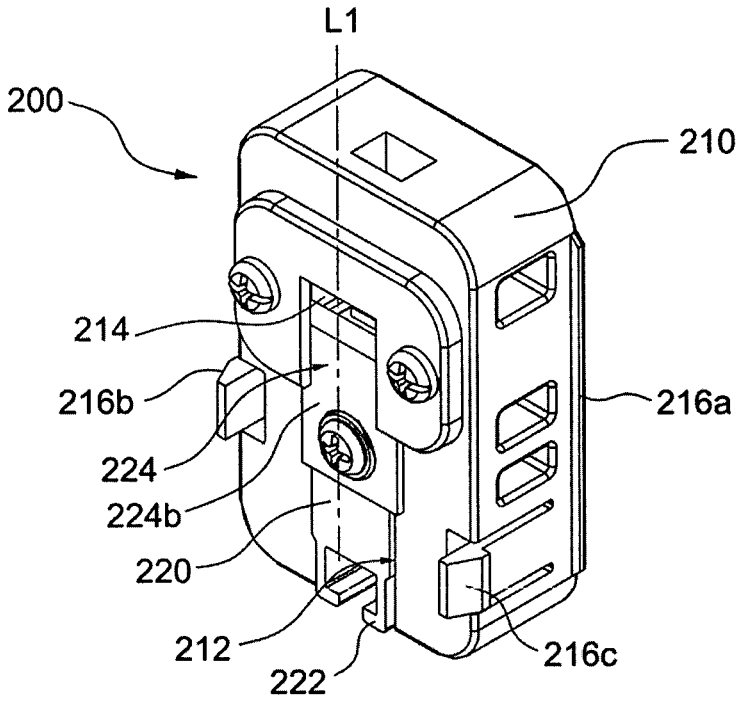
FIG. 2A is a schematic view showing the cassette of one embodiment of the present invention in a resting state wherein a shearing structure is shown.
Figure 2B:
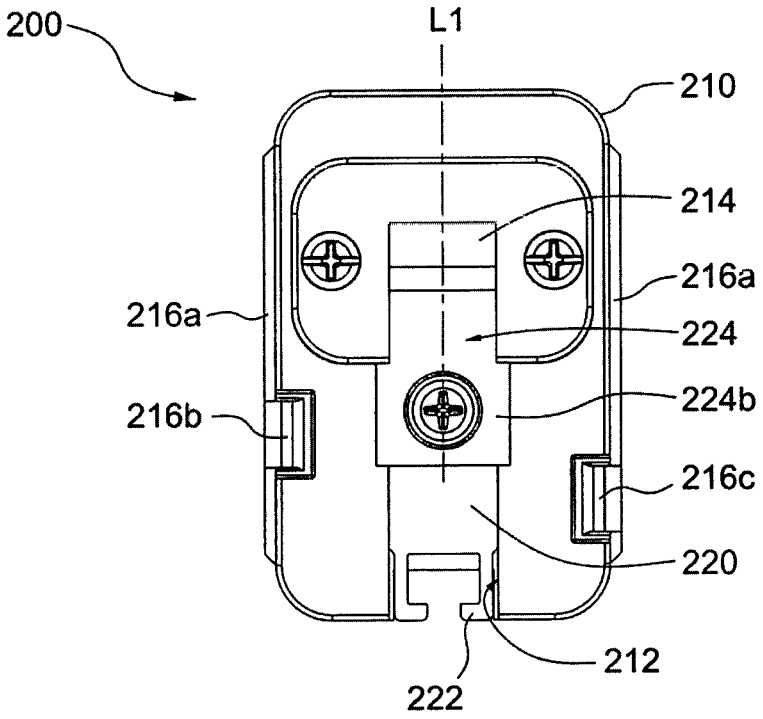
FIG. 2B is another schematic view showing the cassette of the embodiment in the resting state wherein the shearing structure is shown.
Figure 3A:
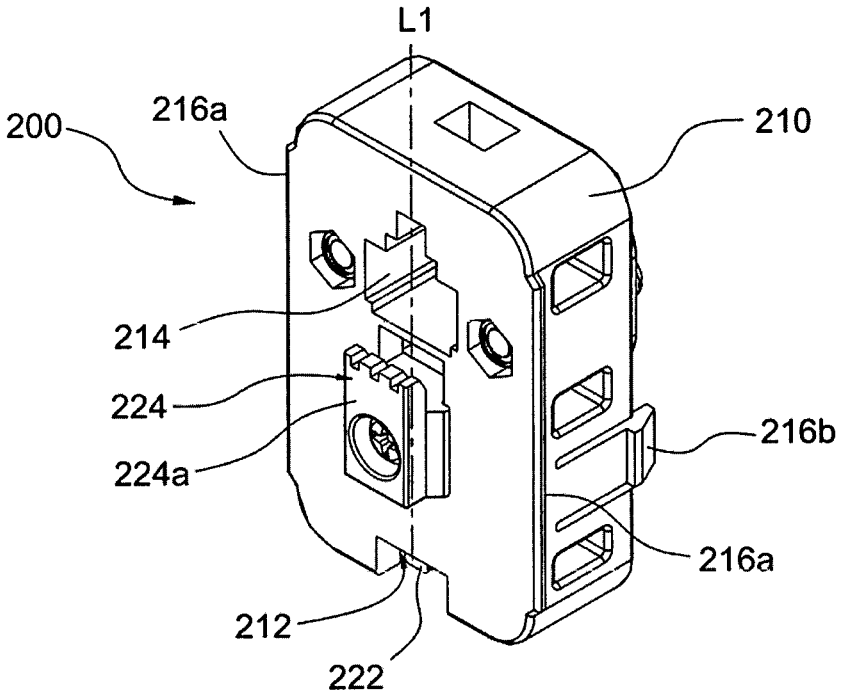
FIG. 3A is a further schematic view showing the cassette of the embodiment in the resting state wherein a crimping structure is shown.
Figure 3B:
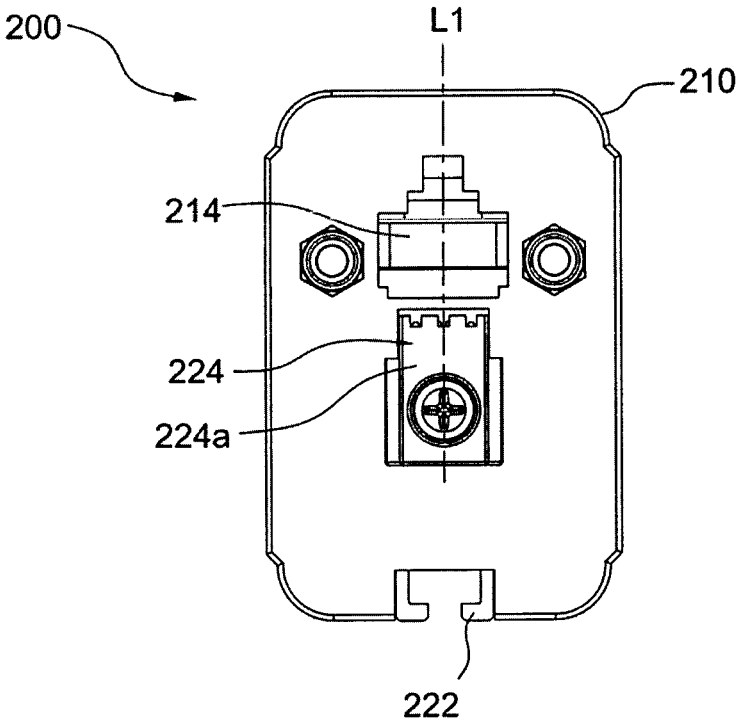
FIG. 3B is still a further schematic view showing the cassette of the embodiment in the resting state wherein the crimping structure is shown.
Figure 4A:
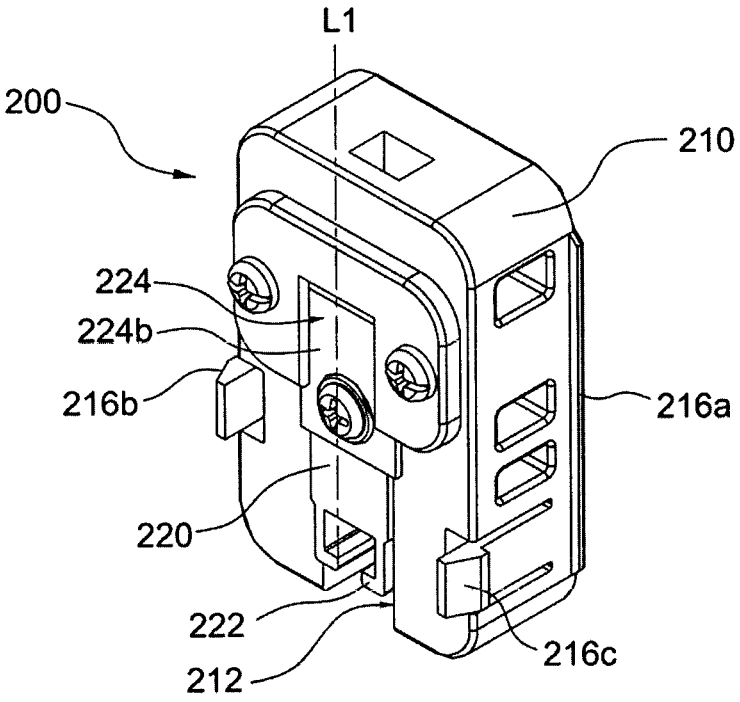
FIG. 4A is a schematic view showing the cassette of the embodiment in a working state wherein a shearing structure is shown.
Figure 4B:
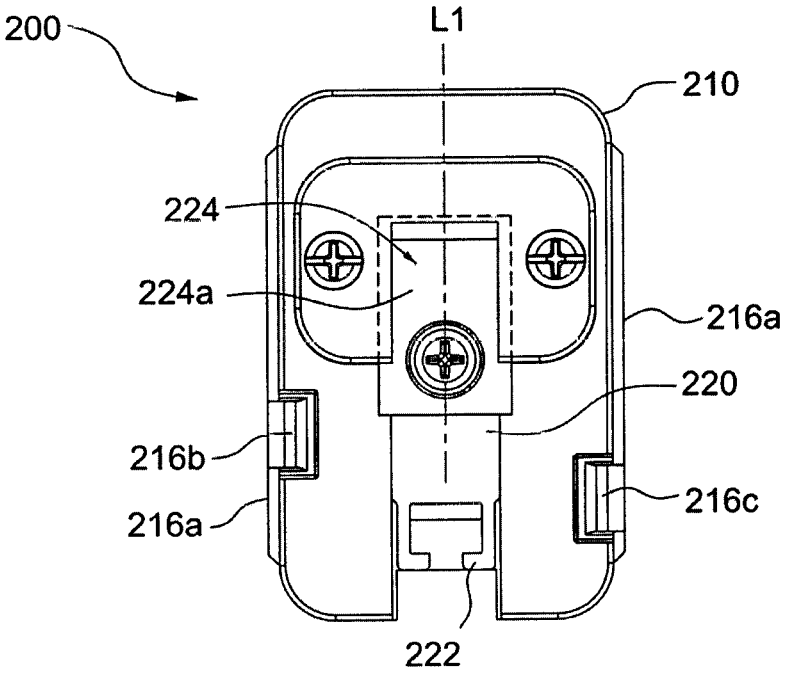
FIG. 4B is another schematic view showing the cassette of the embodiment in the working state wherein the shearing structure is shown.
Figure 5A:
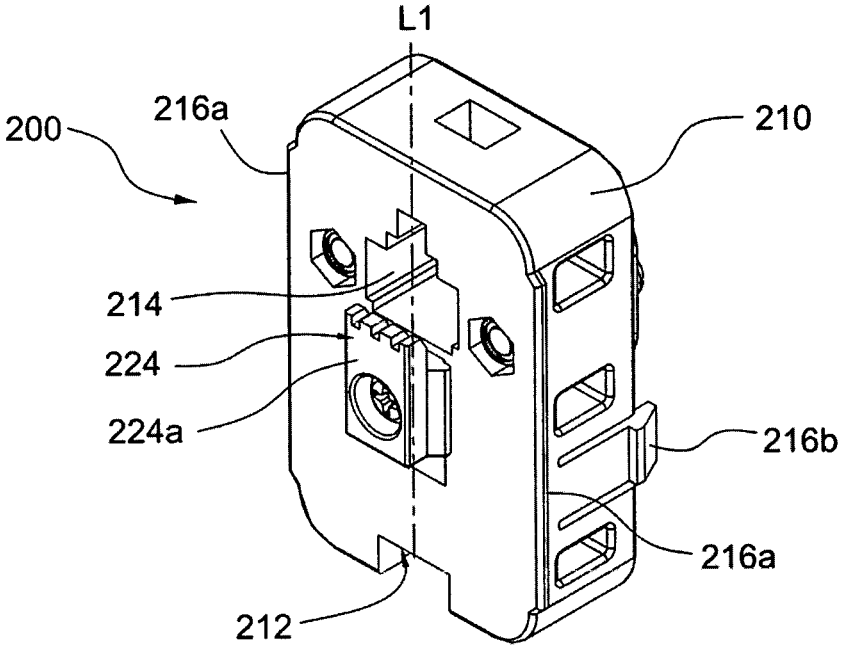
FIG. 5A is a further schematic view showing the cassette of the embodiment in the working state wherein a crimping structure is shown.
Figure 5B:
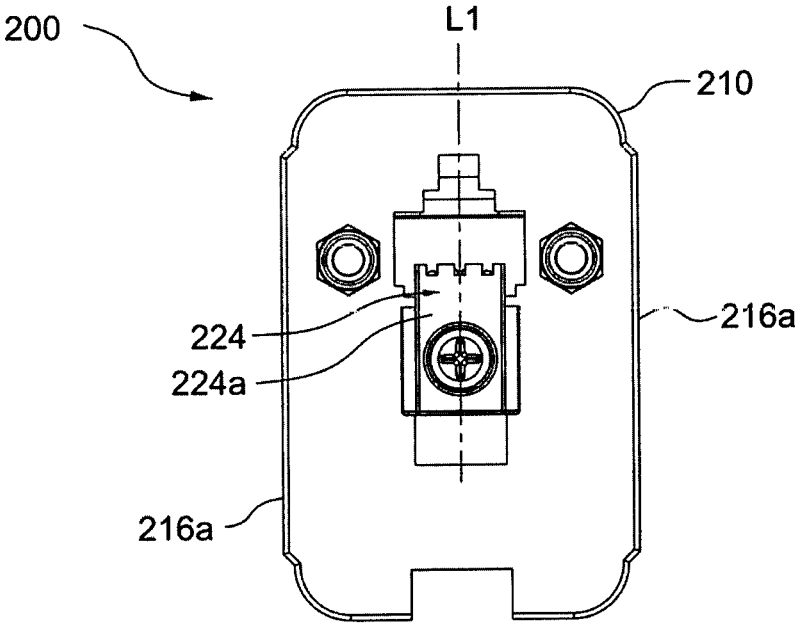

Please refer to FIGS. 1A and 1 B. FIG. 1A shows the crimp tool 10 of one embodiment of the present invention in a resting state wherein the handles 110, 120 thereof are in an expanded position and FIG. 1B shows the crimp tool 10 in a working state wherein the handles 110, 120 of the crimp tool 10 comprises: a tool body 100 and a cassette 200. The tool body 100 comprises: a first handle 110, a second handle 120, a head 130 and a driving element 140. The second handle 120 is pivotally connected with the first handle 110 wherein the second handle 120 pivots along a rotational path between a first position where the second handle 120 is away from the first handle 110 (as shown in FIG. 1A) and a second position where the second handle 120 is adjacent to the first handle 110 (as shown in FIG. 1B). The head 130 is connected with the first handle 110 and has an opening 131 for receiving the cassette 200. The driving element 140 is connected with and actuated by the second handle 120. When a user grasps the handles 110, 120, the second handle 120 urges the driving element 140 to move upward and the cassette 200 is actuated to machine the connector and the cable, such as shearing and/or crimping the connector and the cable. The crimp tool 10 is then switched from the resting state to the working state. When the user releases the handles 110, 120, a spring provided at the pivot of the two handles 110, 120 biases the second handle 120 so that the handles 110, 120 are urged into the expanded position, and the driving element 140 retreats to its original position. The crimp tool 10 is then switched from the working state to the resting state. During the above operation, the direction of motion (i.e., upward or downward direction) of the driving element 140 defines a first axis (L1).

As shown in FIGS. 2A, 2B, 3A, 3B, 7A and 7B, the cassette comprises: a cassette body 210 and a machining block 220. The cassette body 210 is detachably disposed in an opening 131 of the head 130 of the tool body 100 and has a machining opening 214 therein. The cassette body 210 is provided with a slot 212 therein and the machining block 220 is slidably disposed in the slot 212 along the first axis (L1). With this detachable design, the crimp tool 10 of one embodiment of the present invention can crimp connectors and cables with different specifications by using corresponding cassettes 200. The machining opening 214 of the cassette 200 fits with a particular connector (e.g., RJ-45 connector, RJ-11 connector or the like) and cable. Different cassettes can be used with connectors and cables of different specifications. That is, one embodiment of the present invention provides a tool body 100 that can be used with cassettes of different machining openings. The cassette bodies of these cassettes are of the same or similar outer configurations such that all of them can fit with the opening 131 of the same tool body 100.

The machining block 220 slidably provided in the slot 212 of the cassette body 210 and the engagement element 222 of the tool body 100 are interconnected. The machining block 220 has an engagement element 222 for being detachably engaged with the driving element 140 of the tool body 100. Through the engagement element 222, the driving element 140 drives the machining block 220 to slide along the first axis (L1) to move toward or away from the machining opening 214. When the handles 110, 120 are pressed to move toward to each other, the second handle 120 urges the driving element 140 to move upward and the driving element 140 pushes the machining block 220 to slide upward along the first axis (L1) to machine the connector and the cable via the engagement between the driving element 140 and the engagement element 222. In one embodiment of the present invention, the driving element 140 is a male structure, such as a T-shaped protrusion, and the engagement element 222 is a female structure, such as a groove that matches with the T-shaped protrusion. The T-shaped structure prevents the driving element 140 from being easily disengaged from the engagement element 222. As such, the machining block 220 is actuated by the driving element 140 to slide upward or downward in a slot 212 along the first axis (L1).

As illustrated in FIGS. 2A-5B, the machining opening 214 is provided in the cassette body 210 for machining a connector. Corresponding to the machining opening 214, the machining block 220 comprises: at least one machining structure 224. In operation, the engagement element 222 is actuated by the driving element 140 so that the machining block 220 having the engagement element 222 slides along the first axis (L1) in the slot 212 in relation to the machining opening 214. When the machining block 220 is driven to a working position, the at least one machining structure 224 at least partially overlaps with the machining opening 214. As such, the at least one machining structure 224 machines the connector placed in the machining opening 214, such as crimping or shearing a 5 connector having a cable for telephone connections or local area network (LAN).

In one embodiment, the at least one machining structure 224 comprises two machining structures, namely a crimping structure 224*a* disposed at one side of the cassette body 210 and a shearing structure 224*b* disposed at the other side of the cassette body 210. As shown in FIGS. 3A, 3B, 5A, and 5B, the crimping structure 224*a* is a structure for crimping a crystal joint (connector). A shown in FIGS. 2A, 2B, 4A and 4B, the shearing structure 224*b* is a blade for cutting. As illustrated in FIGS. 4A, 4B, 5A and 5B, when the machining block 220 is driven to the working position, the crimping structure 224*a* partially overlaps with one side of the machining opening 214 and the shearing structure 224*b* fully overlaps with the other side of the machining opening 214.

Figure 6A:
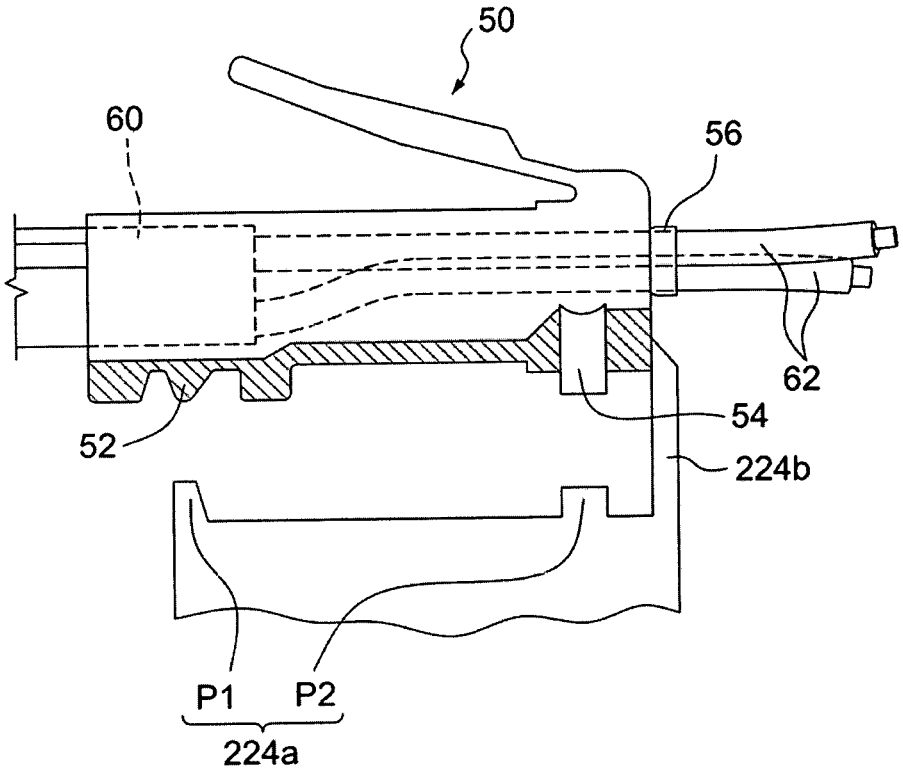
FIG. 6A is a schematic view showing a connector and a cable before being sheared and crimped.
Figure 6B:
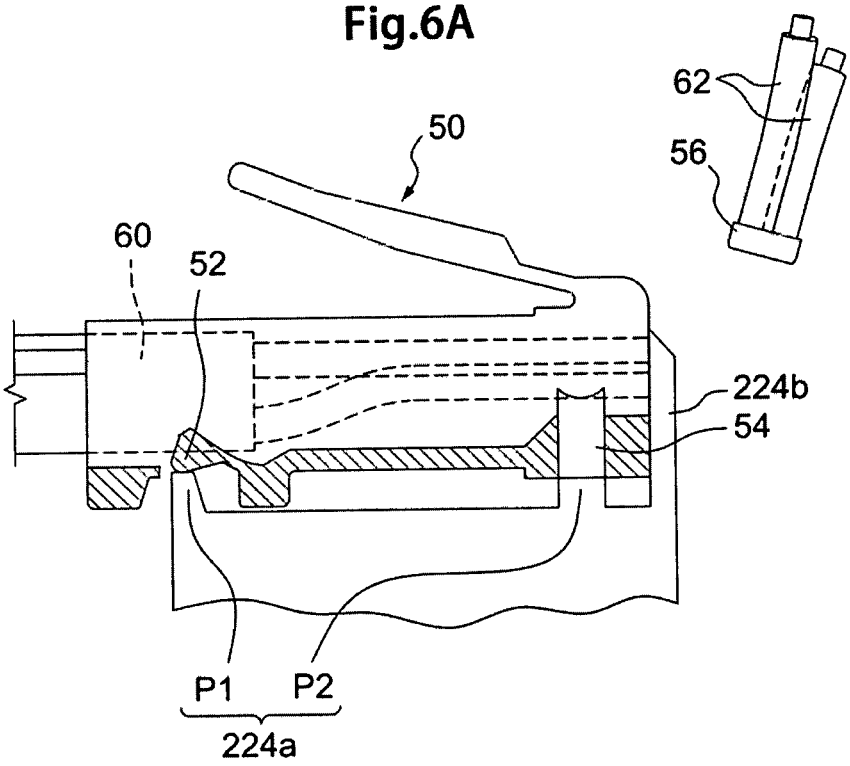
FIG. 6B is a schematic view showing the connector and the cable after being sheared and crimped.

In the embodiment shown in FIGS. 6A and 6B, the crimping structure 224*a* for crimping a crystal connector 50 comprises two crimping blocks P1, P2, which perform the crimping function simultaneously. The first crimping block P1 is for crimping the body of the crystal connector 50 and the second crimping block P2 is provided between the first crimping block P1 and the shearing structure 224*b* for securing the electrical contact blades 54 contained therein to the core(s) 62 of the cable 60. When the machining block 220 is driven by the driving element 140 to the working position, the crimping structure 224*a* partially overlaps with one side of the machining opening 214 and the first crimping block P1 of the crimping structure 224*a* presses against a ridge 52 at the bottom of the crystal connector 50 so that the ridge 52 deforms and breaks. The deformed and broken ridge 52 thus squeezes the outmost insulator(s) of the cable so that the cable 60 is secured to an internal portion of the crystal connector 50. As such, a part of the crystal connector 50 holds the cable 60 and the crystal connector 50 is firmly secured to one end of the cable 60. At the same time, the second crimping structure P2 pushes the electrical contact blades 54 of the crystal connector 50 to move upward and punches through the insulator of the cores 62 of the cable 60 to electrically connect with the cores 62 of the cable 60, so that signals can be transmitted from the cores 62 through the crystal connector 50 to a corresponding female connector.

In one embodiment, the shearing structure 224*b* is a blade for shearing off the redundant parts of the cores 62. When the machining block 220 is driven by the driving element 140 to the working position, the blade 224*b* is moved along the first axis (L1) until it fully overlaps with the side of the machining opening opposite to the crimping structure 224*a* and at the same time shears off the ends of the cores 62 that protrude from one end of the crystal connector 50. In a preferred embodiment, the blade 224 can also be arranged to shear off both the protruded parts of the cores 62 and the appendix 56 of crystal connector 50 as shown in FIGS. 6A and 6B. As such, the ends of the sheared cores 62 are flush with the sheared end of the crystal connector 50. In alternative embodiments of the present invention, the location of the shearing structure 224*b* relative to the crystal connector 50 can be arranged in accordance with the needs of a specific user, and might be different from that shown in FIGS. 6A and 6B.

Figure 7A:
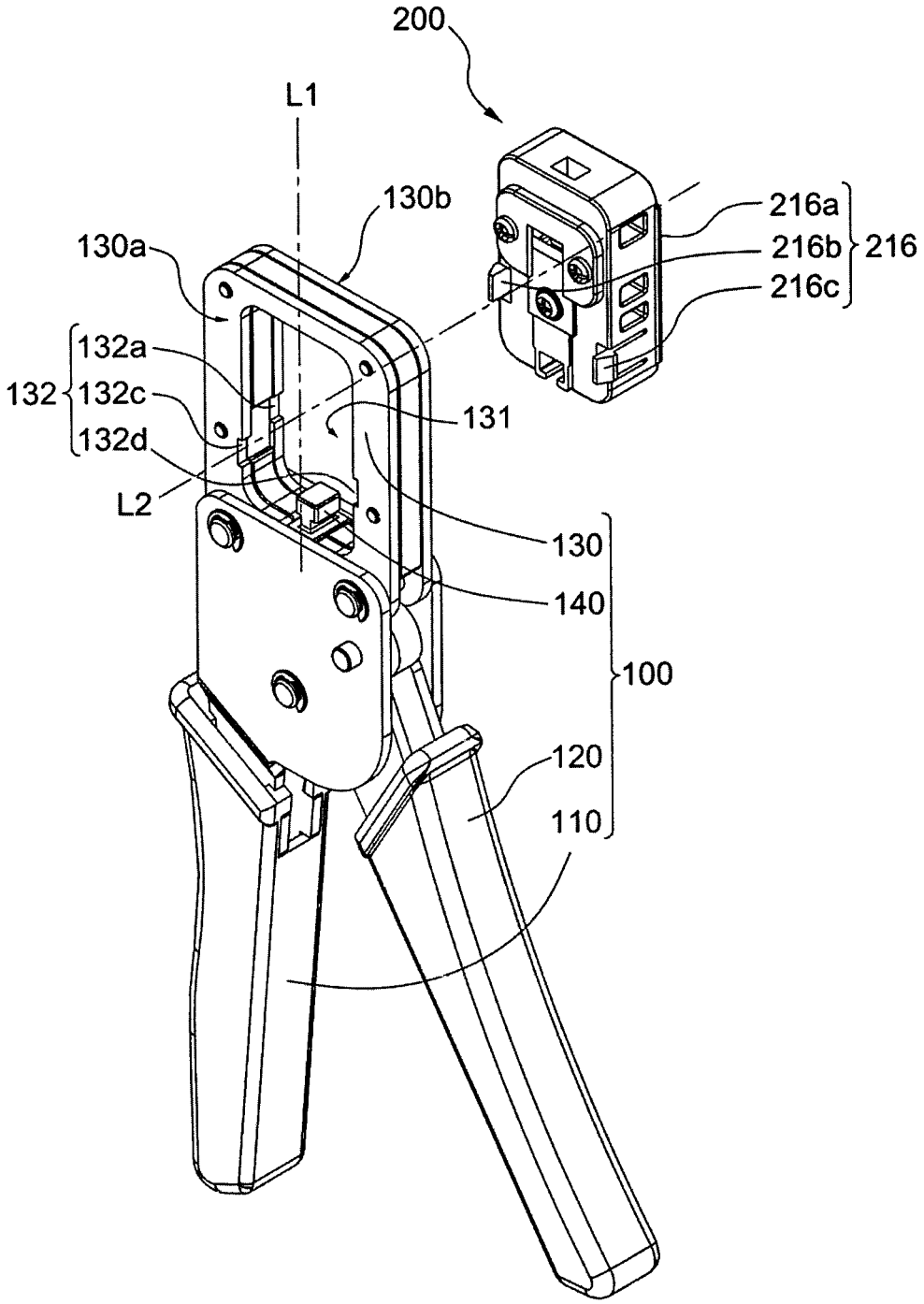
FIG. 7A is a schematic view showing one embodiment of the present invention in which a cassette is to be inserted into an opening of a head of a tool body from one side thereof.
Figure 7B:
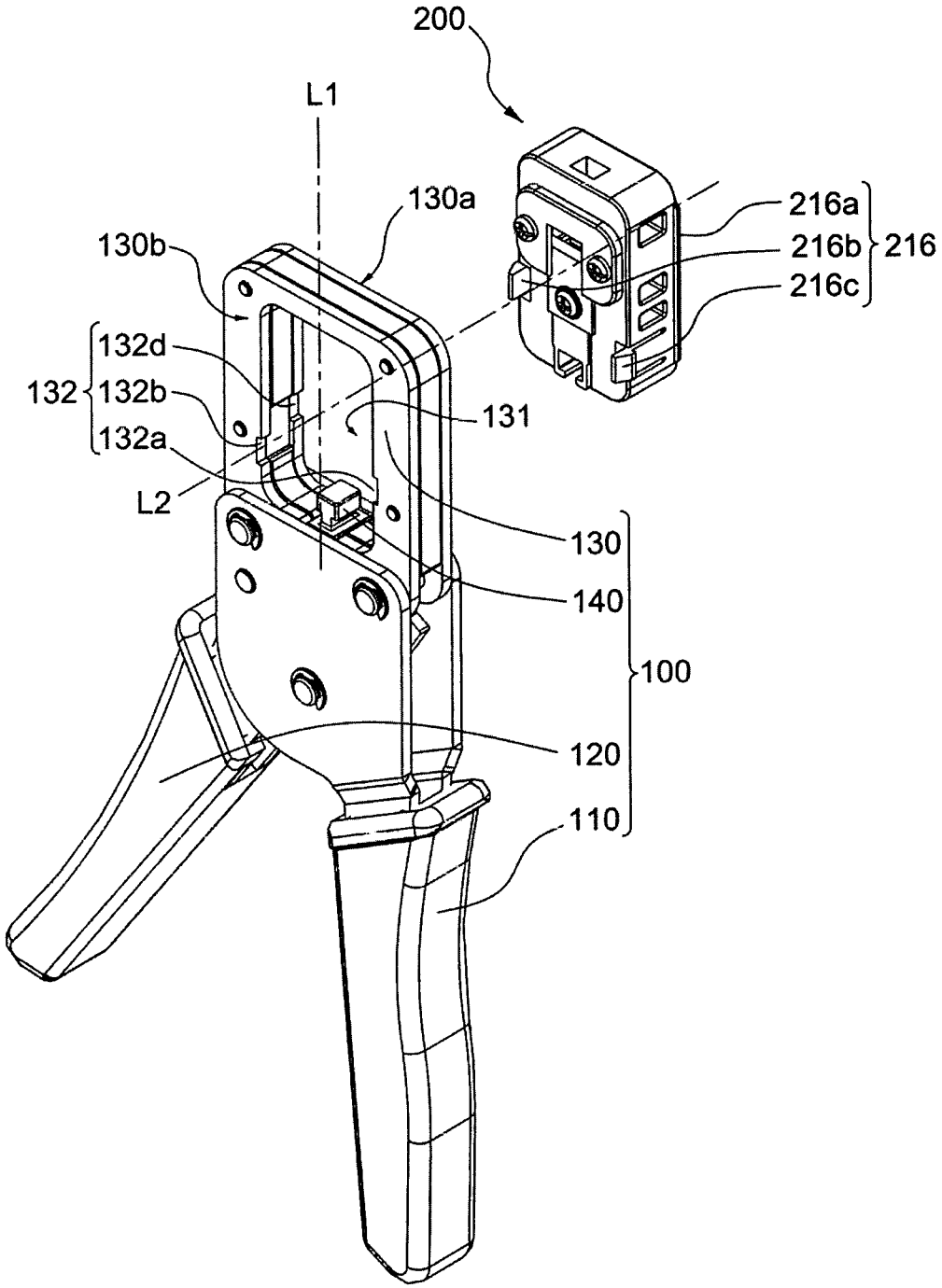
FIG. 7B is a schematic view showing one embodiment of the present invention in which a cassette is to be inserted into an opening of a head of a tool body from the other side thereof.

To ensure that the machining block 220 works steadily and properly when it machines a connector and/or a cable, the cassette 200 should be firmly placed within the opening 131 of the head 130 of the tool body 100. As shown in FIGS. 7A and 7B, the head 130 of the tool body 100 further comprises: a first connecting structure 132 disposed in the inner lateral surfaces of the opening 131 and the cassette body 210 of the cassette 200 further comprises: a second connecting structure 216 disposed thereon, wherein the first connecting structure 132 engages with the second connecting structure 216 so that the cassette body is secured within the tool body 100. The design of the engagements between the first connecting structure 132 and second connecting structure 216 as described below has the benefit of easy assembly of the cassette 200 to the head 130 of the tool body 100 and easy disassembly of the cassette 200 from the head 130 of the tool body 100, in addition to the benefit of the firm engagement between the cassette 220 and the opening 131 of the head 130 of the tool body 100.

The second connecting structure 216 comprises a stopper 216*a* abutting against one of a first surface 130*a* and a second surface 130*b* of the head 130 of the tool body 210 along a second axis (L2) perpendicular to the first axis (L1) when the cassette body 210 is disposed in the opening 131 of the head 130 of the tool body 100. The second connecting structure 216 comprises: a first hook 216*b* and a second hook 216*c* respectively disposed at the two lateral sides of the cassette body 210. The first hook 216*b* and the second hook 216*c* extend away from the stopper 216 a in a direction substantially parallel to the second axis (L2). When the stopper 216*a* abuts against one of the first surface 130*a* and the second surface 130*b* of the head 130 of the tool body 210, the first hook 216*b* and the second hook 216*c* engage with the other one of the first and the second surfaces 130*a*, 30*b* of the head 130 of the tool body 100 so as to secure the cassette 200 in the head 130 of the tool body 100.

Referring to FIGS. 7A and 7B, one embodiment of the present invention provides a crimp tool 10 that is convenient for both right-handed and left-handed users. Specifically, the cassette 200 can be inserted into the opening 131 of the head 130 of the body tool 100 from either the first surface 130*a* or the second surface 130*b* of the head 130 of the tool body 100. As the second handle 120 is pivotable in relation to the first handle 110 with respect to a pivot provided at the joints of the first handle 110 and the second handle 120, the first handle 110 is defined as a stationary handle and the second handle 120 is defined as the moving handle. When a right-handed user uses the crimp tool 10, the cassette 200 might be inserted into the opening 131 of the head 130 of the tool body 100 from the second surface 130*b* of the head 130 as shown in FIG. 7A. As such, the right-handed user can use his/her left hand to hold a connector with cable and place it into the machining opening 214 of the cassette 200 and uses his/her right hand to operate the crimp tool 10. The first handle 110 is placed between and abuts against the thumb and the palm of the right hand so that the first handle 110 is held still. The other four fingers of the right hand are placed upon the second handle 120 for pressing against the second handle 120 to move toward the first handle 110. When the right handle 120 is moved adjacent to (or abutting against) the first handle 110, the machining block 220 is driven by the driving element 140 to the working position and the connector with cable is machined.

Similarly, when a left-handed user operates the crimp tool 10, the cassette 200 might be inserted into the opening 131 of the head 130 of the tool body 100 from the first surface 130*a* of the head 130 as shown in FIG. 7B. Accordingly, the left-handed user can use his/her right hand to hold a connector with cable and place it into the machining opening 214 of the cassette 200 and uses his/her left hand to operate the crimp tool 10. The first handle 110 is placed between and abuts against the thumb and the palm of the left hand so that the first handle 110 is held still. The other four fingers of the left hand are placed upon the second handle 120 for pressing against the second handle 120 to move it toward the first handle 110 so as to machine the connector.

In one embodiment of the present invention, the first hook 216*b* and the second hook 216*c* are asymmetrically disposed at the two lateral sides of the cassette body 210 along the direction of the first axis (L1). The first connecting structure 132 comprises: a first notch 132*a*, a second notch 132*b*, a third notch 132*c* and a fourth notch 132*d* wherein the first notch 132*a* and the third notch 132*c* are disposed in one lateral inner surface of the opening 131 of the head 130 and the second notch 132*b* and the fourth notch 132*d* are disposed in the other lateral inner surface of the opening 131 of the head 130. The first notch 132*a* and the fourth notch 132*d* are at the same first height and the second notch 132*b* and the third notch 132*c* are at the same second height. The first height is higher than the second height. The first notch 132*a* and the second notch 132*b* form a depression from the second surface 130*b* of the head 130 and the third notch 132*c* and the fourth notch 132*d* form a depression from the first surface 130*a* of the head 130.

With the above structures, when the cassette 200 is inserted into the opening 131 of the head 130 of the tool body 100 from the second surface 130*b* of the head 130 as shown in FIG. 7A along the second axis (L2), the first hook 216*b* and the second hook 216*c* respectively engage with the first notch 132*a* and the second notch 132*b*. The heads of the first hook 216*b* and the second hook 216*c* will ultimately abut against the first surface 130*a* of the head 130 and the stopper 216*a* abuts against the second surface 130*b* of the head 130. Similarly, when the cassette 200 is inserted into the opening 131 of the head 130 of the tool body 100 from the first surface 130*a* of the head 130 as shown in FIG. 7B along the second axis (L2), the first hook 216*b* and the second hook 216*c* respectively engage with the fourth notch 132*d* and the third notch 132*c*. The heads of the first hook 216*b* and the second hook 216*c* will ultimately abut against the second surface 130*b* of the head 130 and the stopper 216*a* abuts against the first surface 130*a* of the head 130. Thus, the cassette 200 can be placed into the opening 131 of the head from either the first surface 130*a* or the second surface 130*b* of the head 130 depending on the habits of the users. Under either of the two assembly manners, the hand tool 100 performs the same crimping and/or shearing functions well.

In addition to the benefits mentioned above, with both the crimping structure 224*a* and the shearing structure 224*b* provided at the machining block 220, the crimping tool 100 is capable of being used in one step to simultaneously secure the crystal connector 50 to the cable 60, electrically connect the electrical contact blades 54 of the crystal connector 50 to the cores 62 of the cable 60, and shear off the both the protruded parts of the cores 62 and the appendix 56 of crystal connector 50.

The foregoing embodiments are illustrative of the technical concepts and characteristics of the present invention so as to enable a person skilled in the art to gain insight into the contents disclosed herein and to implement the present invention accordingly. However, it is understood that the embodiments are not intended to restrict the scope of the present invention. Hence, all equivalent modifications and variations made to the disclosed embodiments without departing from the spirit and principle of the present invention should fall within the scope of the appended claims.

What is claimed is:

1. A tool for machining a connector, the tool comprising:

a tool body having a gripping portion and a head portion connected to the gripping portion, the tool including an opening in the head portion;

a cassette body removably inserted into the opening of the head portion of the tool, said cassette body having a machining opening therein for receiving the connector;

a machining block, slidably disposed in said cassette body, said machining block having an engagement element for being detachably engaged with a driving element connected to the gripping portion of the tool;

a shearing unit, slidably disposed in said cassette body, at a position between the machining block and the machining opening;

wherein through said engagement element, said machining block is arranged to be driven by the driving element when the cassette body is disposed in the opening in the head portion to slide the machine block along a first axis to move toward or away from said machining opening, and wherein the machining block slides the shearing unit along the first axis to move toward and away from the machining opening, wherein said cassette body is provided with a slot therein and said machining block is slidably disposed in said slot, wherein said machining block comprises: at least one machining structure, and when said machining block is driven to a working position, said at least one machining structure at least partially overlaps with said machining opening, and wherein said tool body further comprises: a first connecting structure disposed in inner lateral surfaces of the opening and said cassette body further comprises: a second connecting structure disposed thereon, wherein said second connecting structure is arranged to engage with the first connecting structure of the tool body so that said cassette body is arranged to be secured within the tool body.

2. The tool of claim 1, wherein said engagement element is a female structure adapted to receive the driving element comprising a male structure.

3. The tool of claim 1, wherein said cassette body is provided with a slot therein and said machining block is slidably disposed in said slot.

4. The tool of claim 1, wherein said second connecting structure comprises a stopper arranged for abutting against one of a first surface and a second surface of the head of the tool body along a second axis perpendicular to the first axis when said cassette body is disposed in the opening of the head of the tool body.

5. The tool of claim 4, wherein said second connecting structure comprises: a first hook and a second hook respectively disposed at said two lateral sides of said cassette body, said first hook and said second hook extending away from said stopper in a direction substantially parallel to the second axis.

6. The tool of claim 5, wherein said first hook and said second hook are asymmetrically disposed at said two lateral sides of said cassette body along said direction of the first axis.

7. The tool of claim 6, wherein said first hook and said second hook engage with the other one of the first and the second surfaces of the head of the tool body.

8. The tool of claim 7, wherein said first hook and said second hook are disposed at different heights so as to respectively engage with a first notch and a second notch of the head when said cassette body is inserted into the head from the side of the second side surface of the head, and to respectively engage with a third notch and a fourth notch of the head when said cassette body is inserted into the head from the side of the first side surface of the head the first notch and the fourth notch of the head being at the same first height and the second notch and the third notch of the head being at the same second height, the first height being higher than the second height.

9. A crimp tool comprising:

a tool body comprising:

a first handle;

a second handle, pivotally connected with said first handle;

a head, connected with said first handle;

a driving element, connected with and actuated by said second handle, the direction of motion of said driving element defining a first axis; and a cassette, comprising:

a cassette body for being detachably disposed in an opening of said head of said tool body, said cassette body having a machining opening therein for receiving a connector; and a machining block, slidably disposed in said cassette body, said machining block having an engagement element for being detachably engaged with said driving element of said tool body wherein through said engagement element, said driving element drives said machining block to slide along the first axis to move toward or away from said machining opening;

a shearing unit, slidably disposed in said cassette body, at a position between the machining block and the machining opening;

wherein said cassette body is provided with a slot therein and said machining block is slidably disposed in said slot, wherein said machining block comprises: at least one machining structure, and when said machining block is driven to a working position, said at least one machining structure at least partially overlaps with said machining opening, and wherein said tool body further comprises: a first connecting structure disposed in inner lateral surfaces of the opening and said cassette body further comprises: a second connecting structure disposed thereon, wherein said second connecting structure is arranged to engage with the first connecting structure of the tool body so that said cassette body is arranged to be secured within the tool body.

10. Said crimp tool of claim 9, wherein said machining block comprises: at least one machining structure, and when said machining block is driven to a working position, said at least one machining structure at least partially overlaps with said machining opening.

11. Said crimp tool of claim 10, wherein said second connecting structure comprises a stopper abutting against one of a first and a second surfaces of said head of said tool body along a second axis perpendicular to the first axis when said cassette body is disposed in said opening of said head of said tool body.

12. Said crimp tool of claim 11, wherein said second connecting structure comprises: a first hook and a second hook respectively disposed at said two lateral sides of said cassette body, said first hook and said second hook extending away from said stopper in a direction substantially parallel to the second axis.

13. Said crimp tool of claim 12, wherein said first hook and said second hook engage with said other one of said first and said second surfaces of said head of said tool body.

14. Said crimp tool of claim 13, wherein said first hook and said second hook are asymmetrically disposed at said two lateral sides of said cassette body along said direction of the first axis.

15. Said crimp tool of claim 14, wherein said first connecting structure comprises: a first notch, a second notch, a third notch and a fourth notch wherein said first notch and said third notch are disposed in one lateral inner surface of said opening of said head and said second notch and said fourth notch are disposed in said other lateral inner surface of said opening of said head.

16. Said crimp tool of claim 15, wherein said first notch and said second notch form a depression from said second surface of said head and said third notch and said fourth notch form a depression from said first surface of said head.

17. Said crimp tool of claim 16, wherein said first notch and said fourth notch are at same first height and said second notch and said third notch are at same second height, said first height being higher than said second height.

18. Said crimp tool of claim 17, wherein when said cassette body is inserted into said head from said side of said second side surface of said head, said first hook and said second hook respectively engage with said first notch and said second notch and when aid cassette body is inserted into said head from said side of said first side surface of said head, said first hook and said second hook respectively engage with said third notch and said fourth notch.

* * * * *